US006871620B2

(12) United States Patent
Aimone

(10) Patent No.: US 6,871,620 B2
(45) Date of Patent: Mar. 29, 2005

(54) VARIABLE CAM TIMING UNIT OIL SUPPLY ARRANGEMENT

(75) Inventor: Michael George Aimone, Belleville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 523 days.

(21) Appl. No.: 10/063,294

(22) Filed: Apr. 9, 2002

(65) Prior Publication Data

US 2003/0188704 A1 Oct. 9, 2003

(51) Int. Cl.[7] ..... F01L 1/344; F01M 1/00

(52) U.S. Cl. ..... 123/90.17; 123/90.34; 123/196 R

(58) Field of Search ..... 123/90.15, 90.17, 123/90.31, 90.33, 90.34, 196 R, 196 M, 198 C; 464/1, 2, 160; 74/567, 568 R

(56) References Cited

U.S. PATENT DOCUMENTS 5,065,709 A 11/1991 Ito et al.
5,247,914 A * 9/1993 Imai et al. ..... 123/90.17
5,271,360 A * 12/1993 Kano et al. ..... 123/90.17
5,410,994 A 5/1995 Schecter
5,775,279 A * 7/1998 Ogawa et al. ..... 123/90.17
5,803,029 A 9/1998 Yoshihara et al.
5,881,689 A 3/1999 Hochholzer
5,915,348 A 6/1999 Scheidt et al.
6,045,338 A * 4/2000 Morita ..... 417/252
6,234,125 B1 * 5/2001 Neubauer et al. ..... 123/90.17
6,752,108 B2 * 6/2004 Katayama ..... 123/90.17

* cited by examiner

*Primary Examiner*—Weilun Lo
(74) *Attorney, Agent, or Firm*—Dykema Gossett PLLC; Carlos L. Hanze

(57) ABSTRACT

An internal combustion engine arrangement 7 with a variable cam timing unit pressurized oil supply arrangement 49 is provided. A first pump 44 delivers oil through a first check valve 62 to a VCT unit 83 and additionally provides oil to the engine lubrication system. A second oil pump 104 provides pressurized oil to the VCT unit 83 through a second check valve 106. An accumulator 114 is connected between the first 62 and second 106 check valves to pressurize oil delivered to the variable cam timing unit 83.

10 Claims, 3 Drawing Sheets

VARIABLE CAM TIMING UNIT OIL SUPPLY ARRANGEMENT

BACKGROUND OF INVENTION

This invention relates to an automotive vehicle with an internal combustion engine having a variable cam timing unit (VCT), and in particular to an arrangement of a pressurized fluid supply for a VCT of an automotive vehicle internal combustion engine.

Automotive vehicle engines with reciprocal pistons typically have a plurality of cylinder combustion chambers with the reciprocating pistons mounted therein. Each piston is pivotally connected with a piston rod, which is pivotally connected with a crankshaft. A timing gear is mounted at an end of the crankshaft. Typically, each cylinder has at least one intake valve and one exhaust valve. Both the intake valve and the exhaust valve are spring-loaded to a closed position. Each intake and exhaust valve is associated with a rocker arm. To operate the valves, the rocker arms are moved by a set of contacting cam lobes. The cam lobes are mounted on an elongated member known as a camshaft. Attached at an extreme end of the camshaft is a camshaft pulley. The camshaft pulley is powered by the crankshaft via a timing chain or belt which is looped over the camshaft pulley and a crankshaft timing gear. Accordingly, the camshaft is synchronized with the crankshaft and the timing of the opening and closing of the intake and exhaust valves is fixed with respect to the position of the piston within the cylinder combustion chamber.

In an effort to improve the environment by decreasing polluting emissions and increasing vehicle gas mileage, it has become desirable to allow the timing of the cylinder valve operation to vary with respect to the piston position within the cylinder chamber. To provide for the variable valve timing operation, a VCT is provided on the camshaft.

An example of a VCT is a dual oil feed vane-type VCT. A dual oil feed vane-type VCT provides an inner member or hub that is fixably connected to an end face of a camshaft. The hub has a series of vanes which are captured in cavities or pressure chambers provided in an outer member which is concentrically mounted on the hub. The outer member incorporates the camshaft timing pulley. The vanes circumferentially bifurcate the pressure chambers into an advance side and a retard side. A spool valve, fluidly communicative with the pressure chambers via the inner member and the camshaft, controls the fluid pressure in the advance side and retard side of the pressure chambers. Accordingly, the angular position of the timing pulley versus the crankshaft can be varied by controlling the fluid in the advance and retard pressure chambers.

Another example of a dual oil feed VCT is a helical gear type VCT. The helical gear type VCT has an outer member attached to an inner member or hub along a helical gear connection. A pressure chamber is provided between the inner and outer members. The pressure chamber is axially bifurcated by a pressure boundary which contacts the outer member to move the same with respect to the inner member. The outer member can axially move with respect to the inner member. The helical gear interconnection between the inner and outer members causes the outer member to rotate with respect to the inner member and accordingly changes angular position with respect to the inner member.

Both of the aforementioned VCTs utilize engine lubricating oil pressure and flow to phase the camshaft. The VCT must meet minimum phase speed requirements to achieve the desired fuel economy and emission benefits as well as acceptable drivability and the avoidance of stumble/stall conditions. Typically, the engine oil pump in most vehicles cannot meet the oil pressure instantaneous flow requirements of a VCT, especially at low engine speeds and high oil temperatures. Accordingly, most engine oil pumps need to be upsized to a considerable higher flow rate. The increase in flow rate brings a disadvantage of parasitic losses and fuel economy degradation across the entire engine speed range. Since the oil pump pressure requirements are most difficult to meet at low engine speeds and high oil temperatures, a major issue exists with low (500 rpm) idle speeds and ever lower lug limits (as low as 900 rpm with a continuously variable transmission). At these conditions, the prior art approach of increasing the oil pump size will not meet the VCT unit demands, particularly with an engine having dual independent valve systems which require four VCT units for a V-type engine (one inlet valve camshaft, one outlet valve camshaft for each engine bank). It is desirable to provide an oil supply arrangement for an engine with VCT units which do not require a significantly larger engine oil pump than what is presently required.

Scheidt et al. U.S. Pat. No. 5,915,348 provides an oil supply arrangement for a VCT that supplies pressurized oil to the VCT when the motor is off to remove gas pockets which can occur. However, Scheidt et al. does not reveal an arrangement to meet the oil pump pressure requirements at low engine speed and high oil temperatures.

SUMMARY OF INVENTION

The present invention incorporates a small, on-demand auxiliary oil pump in conjunction with an accumulator chamber arranged via check valving to supply the VCT unit. Accordingly, there is no additional requirement for pressurized oil flow to the remainder of the engine and the main engine oil pump supplies the VCT unit and also pumps up the accumulator when the engine speed is adequate to produce the high engine oil pressure needed for VCT operation. The accumulator allows short duration, high flow rate pulses needed to shift the VCT without having to size the main engine oil pump for a constant high flow rate. The present inventive engine arrangement allows little or no modification to existent oil pump energy requirements and enables instantaneous short duration, high flow pulses for activation of up to four VCT units. The present invention supplies adequate oil pressure to permit VCT activation at very low engine speeds (for example, a tip-in from a 500 rpm idle). The present invention also enables the VCT unit to return to the locked start-up position during cranking (important for stability and the prevention of undesired noise of vibration) should the engine inadvertently stall before achieving the locked position (non-normal shutdown situation). This failsafe ability is required for all VCT units that return to a stop in the advancing direction against normal valve train friction torque.

Other advantages of the invention will become more apparent to those skilled in the art upon a reading of the following detailed description and reference to the drawings.

DETAILED DESCRIPTION

Figures 2, 5:
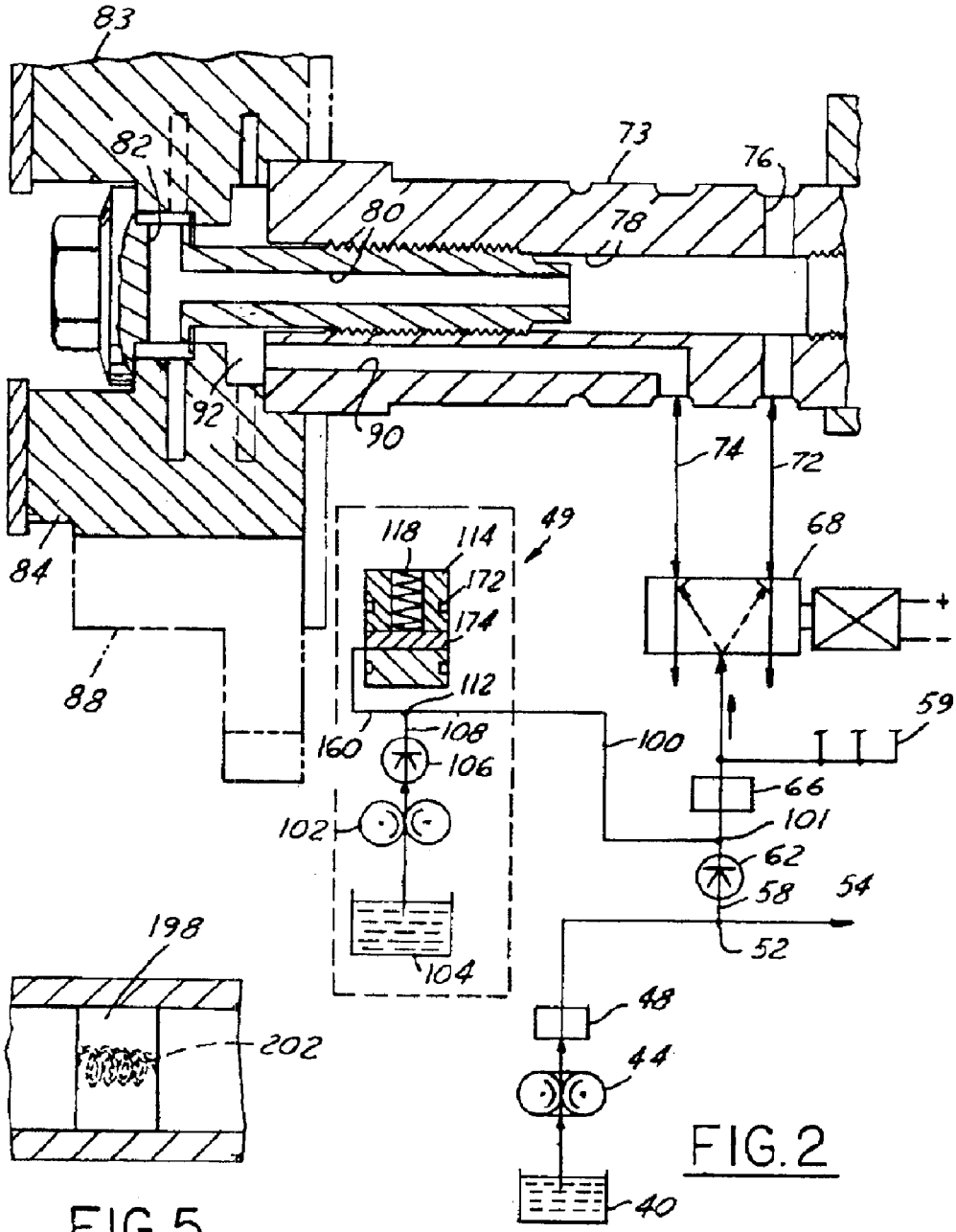
FIG. 2 is a schematic view of an oil supply arrangement according to the present invention for use with the engine shown in FIG. 1.
FIG. 5 is an enlarged view of a stop utilizing the accumulator within the camshaft shown in FIG. 3.
Figure 4:
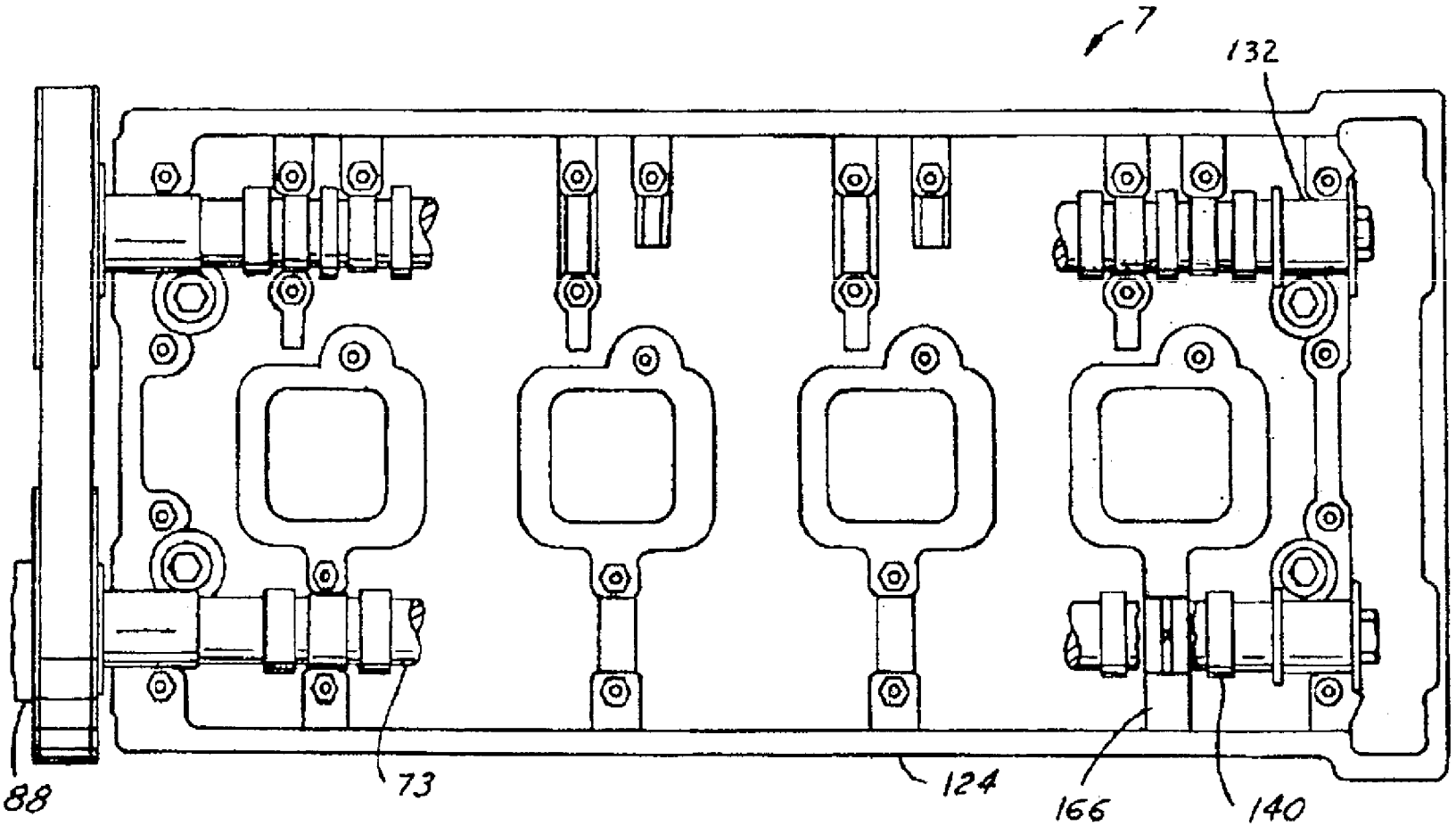
FIG. 4 is a top plan view of the engine shown in FIG. 1 with the cap removed to expose the camshafts.

Referring to FIG. 2, a VCT oil supply arrangement 49 according to the present invention has a sump 40. The sump 40 is fluidly connected with a first or main engine oil pump 44. The main engine oil pump 44 in most applications is powered by the engine crankshaft (not shown) and delivers pressurized oil to and through a filter 48. In other embodiments, the engine oil pump may be electrically powered by a motor.

After leaving filter 48, pressurized oil is then delivered to a T connection 52. At lower engine speeds, virtually all the oil goes through line 54 to accommodate the various lubrication functions of the engine. Oil is also delivered to line 58. Line 58 is connected to an intake of a first check valve 62. Oil passing through check valve 62 passes through a VCT oil filter 66. Oil passing through filter 66 is delivered to solenoid valve 68. Oil from solenoid valve 68 may be delivered or removed into an intake camshaft 73, lines 72 and 74. Line 72 connects to a first passage that includes a cross bore 76, an axial bore 78, VCT fastener bore 80 and VCT fastener cross bore 82 to pressurize a retard side of VCT pressure chamber 83, which extends between a VCT hub 84 and a VCT timing pulley unit 88. Alternatively, the solenoid valve 68 may deliver pressurized fluid through line 74 through a second passage that includes a longitudinal bore 90 which, in turn, connects to a chamber 92 which feeds into an advance side of a pressure chamber between the hub 84, a VCT pulley unit 88. A more detailed review of the working of the VCT unit can be gained by a review of Diggs, et al., U.S. patent application Ser. No. 09/742,707, filed Dec. 20, 2000 commonly assigned. Line 58 has a T connection 101 with a line 100.

A second smaller oil pump 102 has a suction line connected with a sump 104 that can be separate or combined with the other oil sump 40. The second oil pump 102 can be camshaft driven or electrically powered by a motor. The second oil pump delivers pressurized fluid through a second check valve 106. The second check valve 106 has an outlet 108 which is fluidly connected with a T connection 112. T connection 112 has one end connected with a line 160. Line 160 connects with an accumulator 114. The accumulator 114 has a coil spring compliance member 118 to pressurize the contents of the accumulator 114. The accumulator 114 can be in a rearward end of a camshaft 73. In alternative embodiments, not shown, the accumulator is a standalone member.

Figure 1:
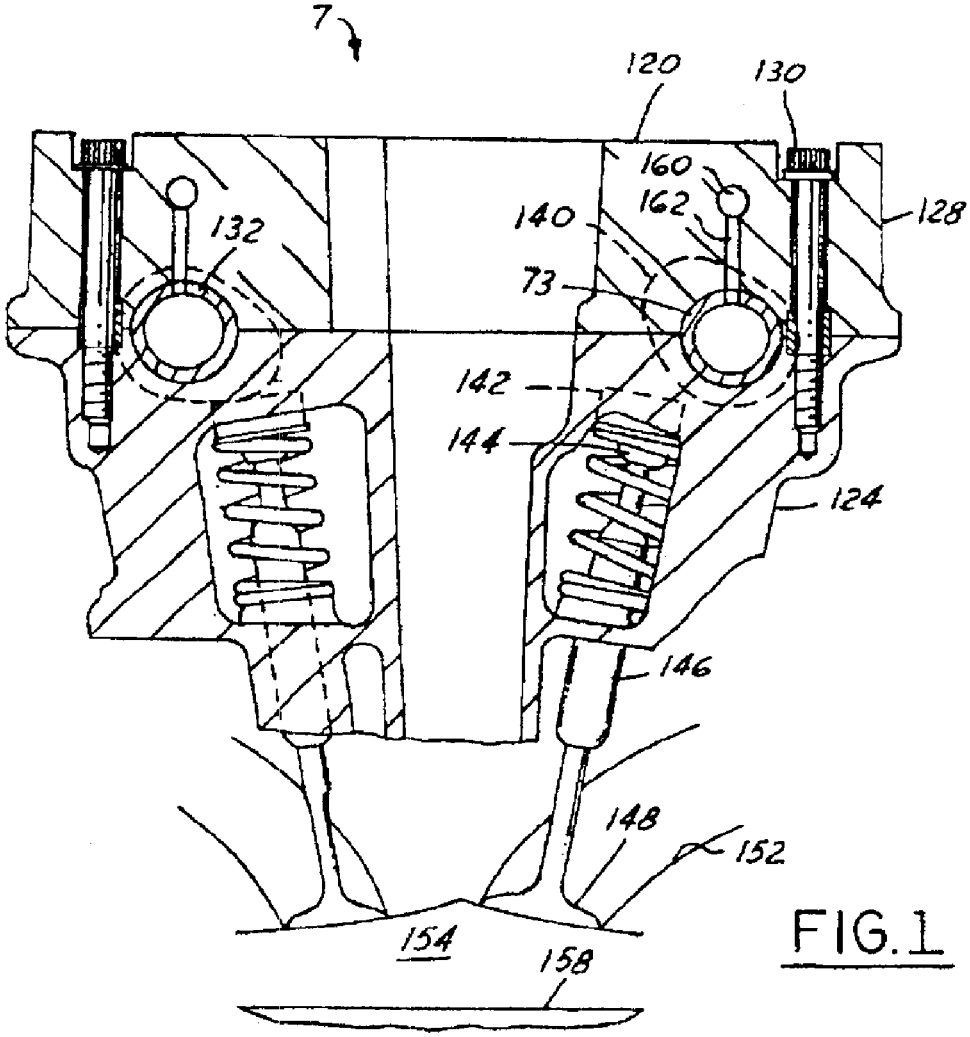
FIG. 1 is a sectional view of an automotive internal combustion engine arrangement of the present invention.

Referring to FIG. 1, the automotive engine arrangement 7 has an engine block 120. The engine block 120 has an upper head which includes a base 124. The base 124 is covered by a cap 128. The cap 128 is joined with the base 124 by a series of cap screws 130. The base 124 and cap 128 rotatably mount overhead intake and exhaust camshafts 73, 132.

Figure 3:
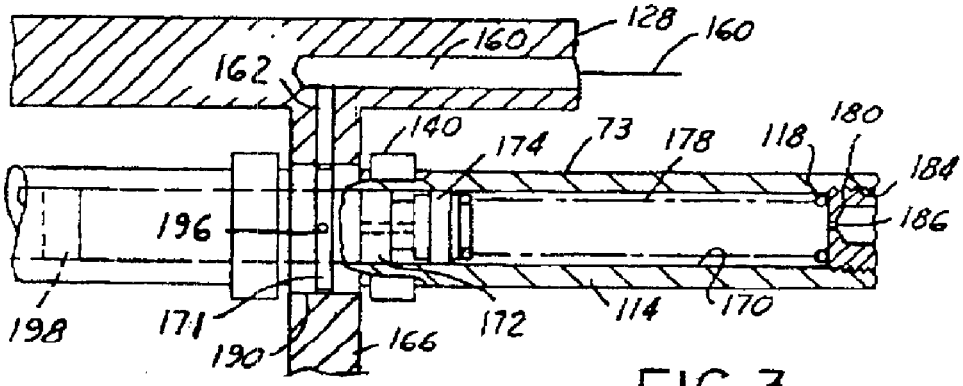
FIG. 3 is a sectional view of a camshaft having an internal accumulator which is utilized in the VCT oil supply arrangement shown in FIG. 2.

Referring to the intake camshaft 73, a cam lobe 140 is provided for making contact on a tappet 142 (illustrated out of normal position in contact with lobe 140). The tappet 142 is operatively associated with an end 144 of a poppet valve 146. The poppet valve is spring-loaded to a closed position. Rotation of the cam lobe 140 allows the poppet valve 146 to open and close. The poppet valve 146 has a valve head 148. The valve head 148 controls flow through an inlet passageway 152. The inlet passageway 152 receives air from the air induction system of the engine block (not shown). A combustion chamber 154 slidably mounts a reciprocating piston 158. The cap 128 has a pressurized oil line 160. Pressurized oil line 160 has a T connection 162. T connection 162 extends into camshaft bearing 166 (FIG. 3).

Fitted within the camshaft 73 is the accumulator 114. The accumulator 114 has a rearward internal cavity 170 provided by the internal bore of the camshaft. Press fitted within the bore cavity 170 is a stop 172. The stop 172 provides a limit for a pressure boundary member or piston 174. The boundary piston 174 is biased by a coil spring 118. The spring 118 provides the compliance to pressurize the accumulated lubricating oil. The spring 118 has a rear end which is set by a core screw 180. Core screw 180 can be turned within a threaded section 184 to set the spring tension on the spring 178. Screw 180 has a hole 186 to allow for any lubricating oil or entrapped air to exit the camshaft bore cavity 170 rearward (or to the right) of the piston 174.

The camshaft 73 has an enlarged bearing portion 190 which is fitted within the bearing 166. The lower part of bearing 166 is provided integral with the engine base 124. The upper portion of the camshaft bearing 166 is provided by an integral portion of the cap 128. The camshaft 73 has an outer annular groove 171. The groove 171 is intersected by a series of geometrically spaced radial bores 196. An O-ring (not shown) positioned in parallel grooves in the camshaft 73 or the bearing 166 can be provided to laterally seal groove 171.

After leaving check valve 106, fluid from pump 102 goes to T connection 112. T connection 112 connects with line 160. The line 160 connects with the accumulator 114. The accumulator 114 also has the volume within the camshaft 73 on the side of camshaft enlarged portion 190 generally opposite the press fit stop 172. Another press fit or screwed stop 198 provides the second pressure boundary. The stop 198 has an extremely small diameter tortuous path 202 extending therethrough to relieve any entrapped air out of the chamber of the accumulator 114 (FIG. 5).

During normal operation, the oil pump 44, which is powered by the crankshaft will have its suction connected with the sump 40. Pressurized oil will be delivered through the filter 48 and proceed to the T connection 52. Assuming the engine's rotational speed is sufficiently high, lubrication oil will be delivered through the remainder of the engine through a lube system through line 54 and pressurized oil will be delivered through the check valve 62 and filter 66 to the solenoid valves 68.

In situations where engine rotational speed is low, the pressure of the oil delivered by the main oil pump 44 will not be sufficiently high to supply the solenoid valve 68 to operate the VCT units. In a V block engine having independently variable inlet and outlet valve trains, line 58 after passing through the filter 66 branches off to three additional lines 59 which have an associated solenoid valve 68 for the other engine VCTs.

If the engine rotational speed is below a given valve, all the oil pressurized by the pump 44 will not be able to pass the check valve 62. Accordingly, all the oil will be delivered to the engine oil lubrication system through line 54. The pump 102 can be powered by the crank shaft or by an electric motor (not shown). The pump 102 will deliver pressurized oil past the check valve 106 into line 108. Pressurized oil in line 108 will then be delivered through line 100 and to T connection 101. Pressurized oil from T connection 101 will enter into line 58 and will be delivered to the solenoid 68 when there is a high volume demand by the various VCT units.

The size of the pump 102 may be minimized due to the availability of the accumulator 114 to provide additional volume when short duration, high volume pressurized oil is needed by the VCT units 83. Depending upon the pressurized fluid demand of the whole system, there can be additional accumulators similar to that of 114 provided in the other camshafts of the engine which can be separately connected with the line 100 or in still another alternative, may be directly connected with an individual filter and a respective line 59. All such accumulators will be fluidly connected with the pump 102 via a check valve arrangement.

If the pump 102 is directly connected to the camshaft, minimizing its size is even more beneficial since parasitic losses can be held to a minimum while still providing a large volume of pressurized oil for the VCT units due to the availability of the accumulator or accumulators 114. During high engine rotational speed, if the pump 102 is torsionaly fixed with the crankshaft, then the pressure beyond the check valves 62, 106 will increase. The increased pressure will require a greater pressure in line 58 to pass through the check valve and accordingly, the increase in the oil pressure will be delivered to the remainder of the oil lubrication system as desired.

Although accumulator 114 has been shown in the capacity of use with a VCT system, accumulator 114 can have other uses such as hydraulic cam lifters, hydraulically actuated poppet valves, or in other situations where accumulator systems can be used with internal combustion engines.

While the invention has been described in conjunction with preferred embodiments, it will be understood that it is not intended to limit the invention to those particular embodiments. On the contrary, it is endeavored to cover all alternatives, modifications and equivalents as may be included within the spirit and scope of the invention as it is encompassed by the description and as defined by the appended claims.

What is claimed is:

1. An internal combustion engine arrangement comprising:

an engine block with at least one combustion chamber with a passageway fluidly communicating with said combustion chamber, said combustion chamber slidably mounting a reciprocating piston therein;

a valve controlling fluid communication through said passageway;

a camshaft with lobes for contacting said valve to control a position of said valve;

a hydraulically powered variable cam timing unit to phase a rotation of said camshaft with respect to a position of said piston within said combustion chamber;

a first pump for providing pressurized oil for lubrication to said engine, said first pump additionally providing pressurized oil to said variable cam timing unit through a first check valve;

a second pump for providing pressurized oil to said variable cam timing unit through a second check valve; and an accumulator connected between said first and second check valves to pressurize oil delivered to said variable cam timing unit.

2. An internal combustion engine arrangement as described in claim 1, wherein said accumulator is provided within an internal cavity of said camshaft of said engine arrangement.

3. An internal combustion engine arrangement as described in claim 1, having a plurality of camshafts with variable cam timing units.

4. An internal combustion engine arrangement as described in claim 1, wherein said second pump has a smaller capacity than said first pump.

5. An internal combustion engine arrangement as described in claim 1, wherein said second pump is powered by an electric motor.

6. An internal combustion engine arrangement as described in claim 1, wherein said second pump is powered by a crankshaft of said engine.

7. An internal combustion engine as described in claim 1, wherein said first pump is powered by a crankshaft of said engine.

8. An internal combustion engine arrangement as described in claim 1, having a plurality of accumulators.

9. An internal combustion engine arrangement comprising:

an engine block having a plurality of combustion chambers with inlet and exhaust passageways fluidly communicating with said combustion chambers, said combustion chambers slidably mounting a respective reciprocating piston therein;

an exhaust valve and an inlet valve controlling fluid communication through said inlet and exhaust passageways;

an inlet camshaft and an exhaust camshaft with lobes for connecting said inlet and exhaust valves to control a position of said valves;

hydraulically powered variable cam timing units that phase a rotation of said inlet and exhaust camshafts with respect to a position of said piston within said combustion chambers;

a crank shaft driven first pump for providing pressurized oil for lubrication to said engine, said first pump additionally providing pressurized oil to said variable cam timing units through a first check valve;

a second oil pump for providing pressurized oil to said variable cam timing units through a second check valve; and an accumulator connected between first and second check valves to pressurize oil delivered to said variable cam timing units.

10. A method of operating an internal combustion engine comprising:

providing an engine block with at least one combustion chamber with a passageway fluidly communicating with said combustion chamber;

slidably mounting a reciprocating piston within said combustion chamber;

controlling fluid communication through said passageway with a valve;

contacting said valve with a camshaft to control a position of said valve;

hydraulically powering a variable cam timing unit to phase a rotation of said camshaft respective to a position of said piston within said combustion chamber;

providing pressurized oil lubrication of said engine with a first pump and additionally providing pressurized oil to the variable cam timing units through a first check valve;

providing pressurized oil to the variable cam timing units with a second pump through a second check valve; and connecting between said first and second check valves an accumulator to pressurize oil delivered to said variable cam timing unit.

* * * * *